United States Patent [19]

Dorner et al.

[11] Patent Number: 4,754,541

[45] Date of Patent: Jul. 5, 1988

[54] METHOD AND APPARATUS FOR JOINING AND FOLDING CONTAINER SECTIONS TO FORM A HINGED CONTAINER

[75] Inventors: Wolfgang C. Dorner, Oconomowoc; Mark C. Wedell, Delafield; Michael C. Allen, Oconomowoc, all of Wis.

[73] Assignee: Dorner Mfg. Corp., Hartland, Wis.

[21] Appl. No.: 15,849

[22] Filed: Feb. 17, 1987

[51] Int. Cl.[4] ..... B21D 39/02

[52] U.S. Cl. ..... 29/463; 29/33 K; 29/429; 29/712; 29/822; 198/444; 198/451; 198/462; 493/29; 493/84; 493/177; 493/180; 493/901

[58] Field of Search ..... 53/377; 198/444, 451, 198/462; 220/337, 338; 493/84, 29, 177, 180, 901; 29/33 K, 442, 453, 428, 429, 434, 525, 463, 712, 714, 720, 773, 822

[56] References Cited

U.S. PATENT DOCUMENTS

| | | | |
|---|---|---|---|
| 1,446,359 | 2/1923 | Thom | 29/33 K X |
| 2,971,443 | 2/1961 | Striplin | 53/377 |
| 3,144,119 | 8/1964 | Nigrelli et al. | 198/444 |
| 3,181,219 | 5/1965 | Deshaies | 29/429 X |
| 3,381,358 | 5/1968 | Eitzinger | 29/773 |
| 3,393,444 | 6/1968 | Peters et al. | 220/338 X |
| 4,590,745 | 5/1986 | Randles | 53/377 X |

*Primary Examiner*—P. W. Echols
*Assistant Examiner*—Andrew E. Rawlins
*Attorney, Agent, or Firm*—Andrus, Sceales, Starke & Sawall

[57] ABSTRACT

An apparatus for joining and folding container sections to form a hinged container. Two container sections are transported in end-to-end relation on a conveyor and the downstream section is engaged with a stop while a pusher member is pivoted into engagement with the trailing edge of the upstream section to force the sections together and engage snap fitted hinge elements on the two sections. The hinged container is then discharged from the first conveyor onto a second conveyor located at a level beneath the first conveyor and operating at a slower speed than the first conveyor. As the leading section of the hinged container falls from the upper conveyor onto the lower conveyor the increased speed of the upper conveyor will fold the trailing section over the leading section to provide a closed hinged container. The closed container then passes under a spring loaded pressure member which ensures that locking elements on the two container sections are fully engaged.

22 Claims, 5 Drawing Sheets

FIG. 5
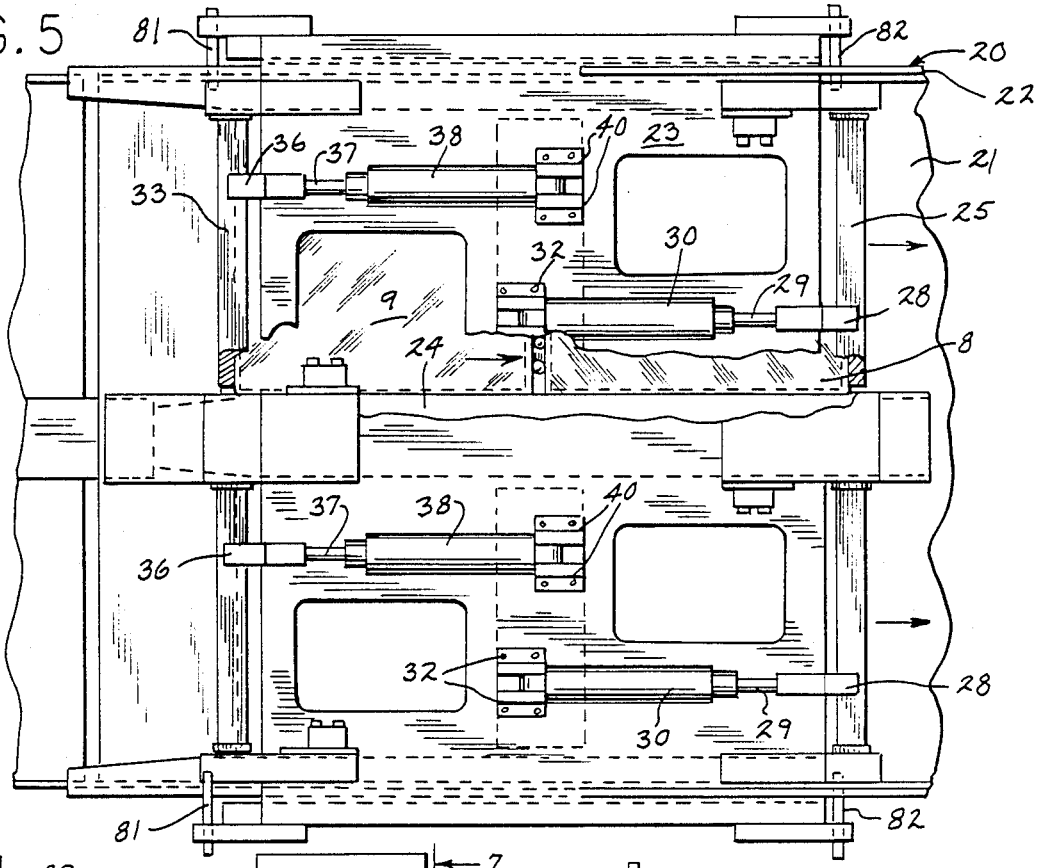
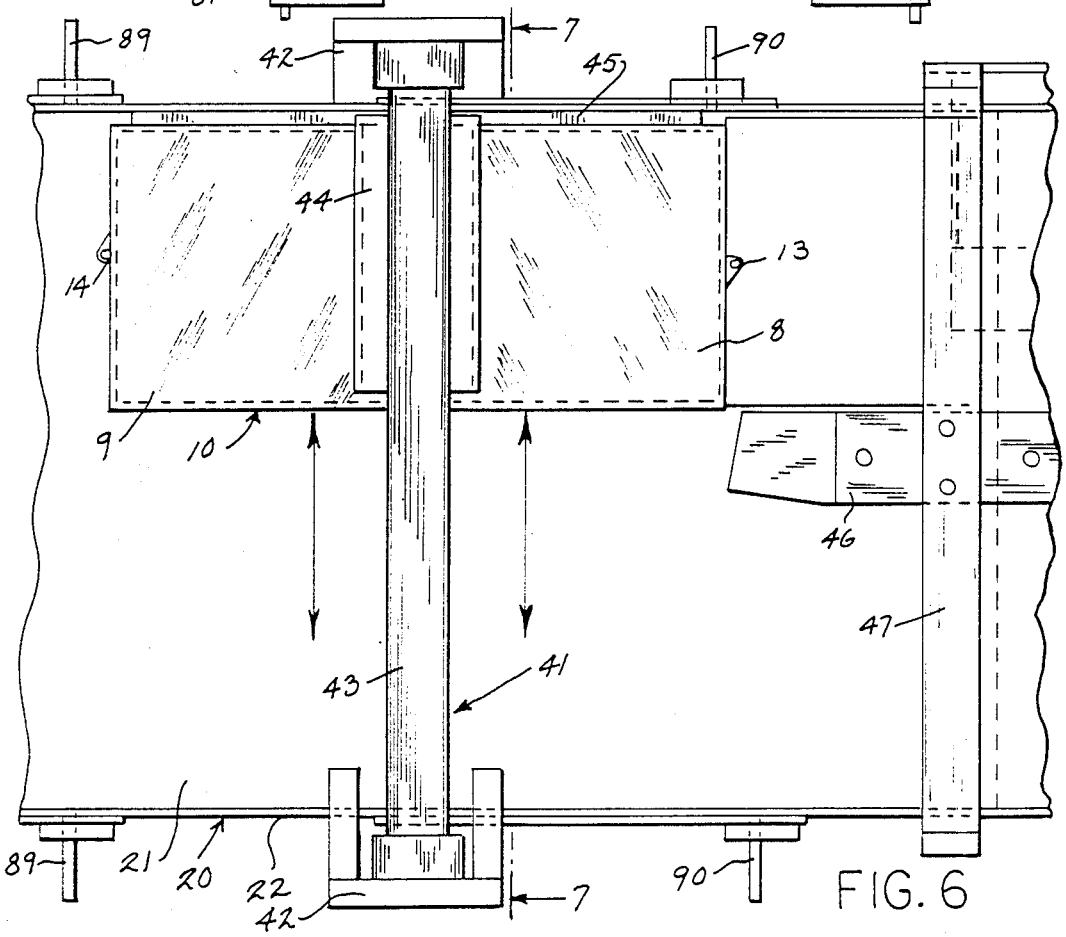
FIG. 6

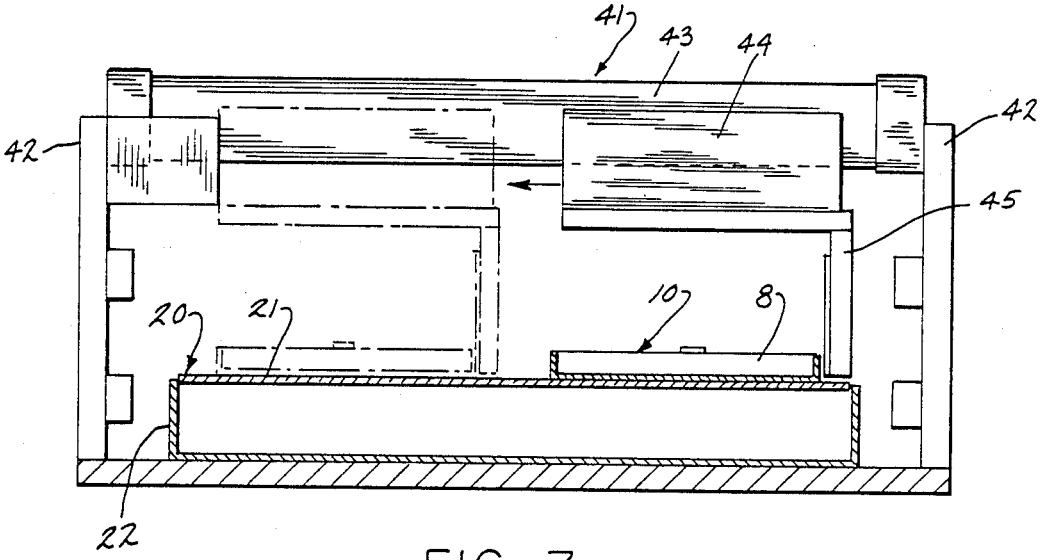
FIG. 7
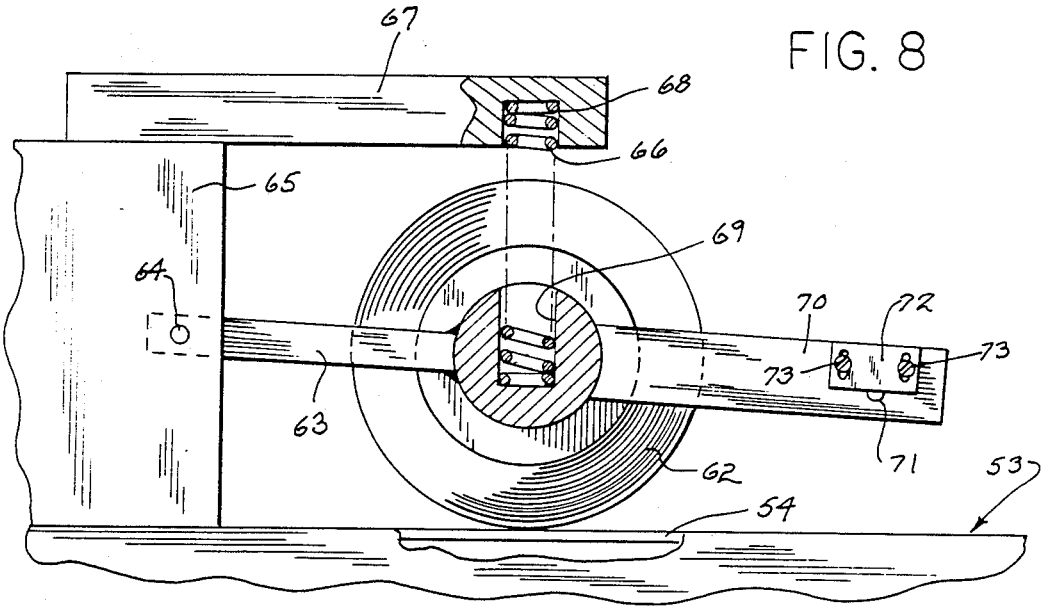
FIG. 8
FIG. 9
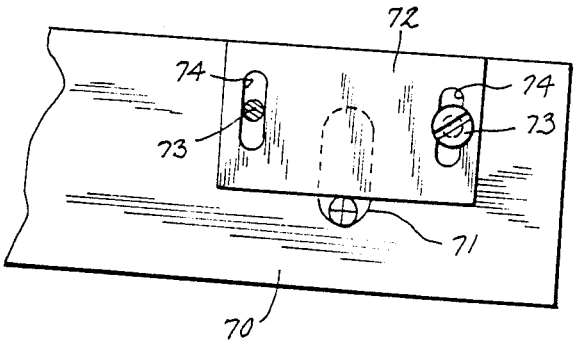

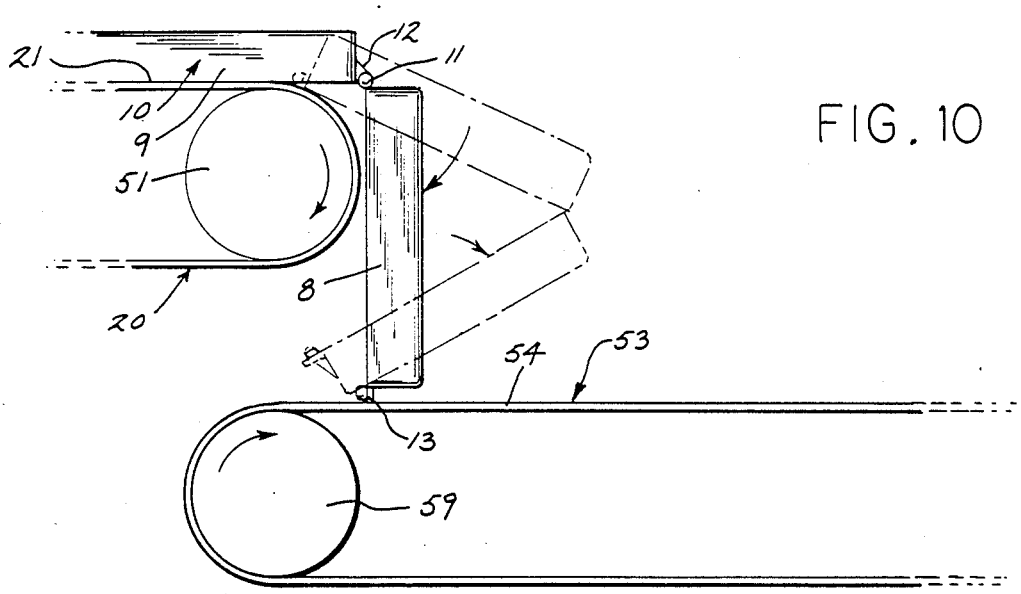
FIG. 10
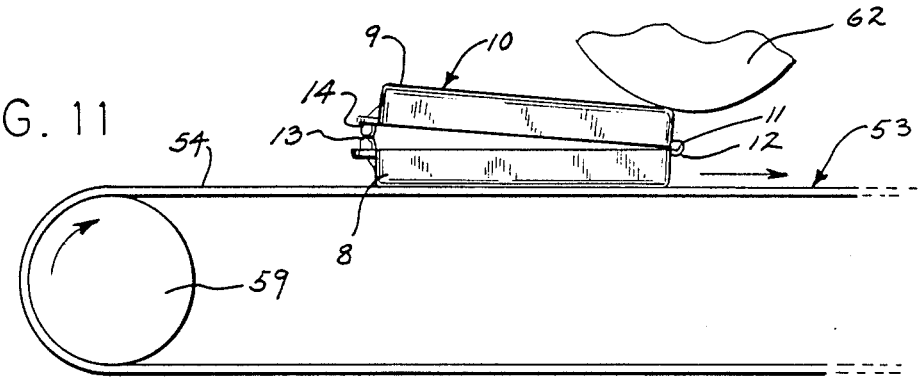
FIG. 11
FIG. 12
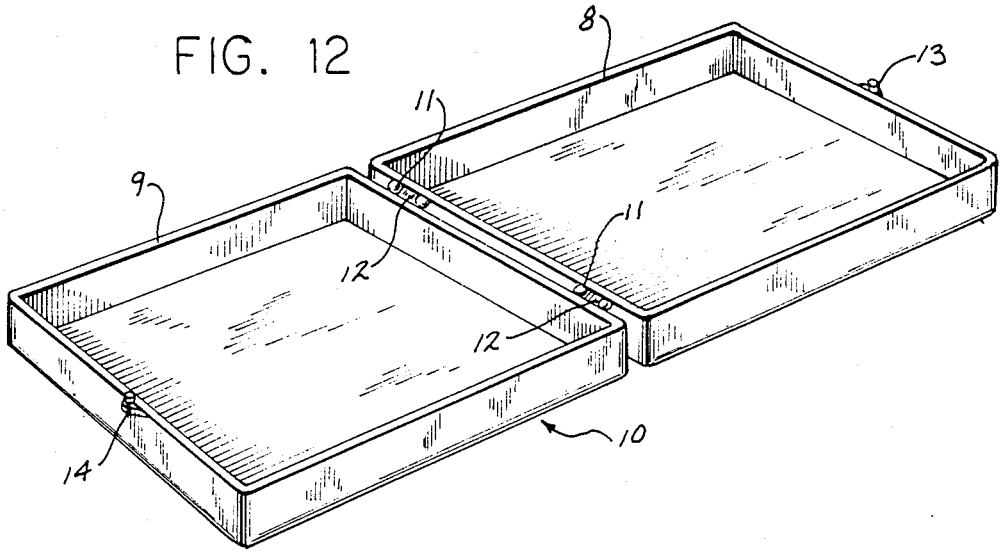

METHOD AND APPARATUS FOR JOINING AND FOLDING CONTAINER SECTIONS TO FORM A HINGED CONTAINER

BACKGROUND OF THE INVENTION

Hinged containers or boxes are frequently used to contain small products such as compact recording discs. The typical container is formed of two open top molded plastic trays or sections. Each section has integrally molded hinged elements which are snap fitted with hinge elements on the other section to form the hinged container. In addition, the mating ends of the hinged container have integrally molded locking elements which are snapped together to hold the container in a closed condition.

In the past, the molded container sections have been manually assembled and folded to a closed position. This has been a tedious and time consuming operation.

SUMMARY OF THE INVENTION

The invention is directed to an apparatus for automatically joining and folding container sections to form a hinged closed container. In accordance with the invention, two container halves or sections are conveyed in an end-to-end relation on an endless belt conveyor. A stop bar is located above the conveyor and is moved to an obstructing position to halt the movement of the leading container section. A pivoting bar is then brought into engagement with the trailing end of the trailing container section to move the trailing section toward the leading section and cause hinge elements on the two container sections to be snap fitted together to provide a hinged container.

After joining of the two sections, the stop bar is elevated enabling the hinged container to move downstream on the conveyor.

Located at a lower level beneath the end of the first conveyor is a second conveyor. As the hinged container approaches the end of the first conveyor, the leading section of the container will fall from the end of the first conveyor and engage the lower or second conveyor which is operating at a slower speed. Continued operation of the faster moving upper conveyor will act to fold the trailing section over the leading section of the hinged container to bring the container sections into a closed condition.

As the closed container is conveyed along the second conveyor it passes beneath a spring loaded roller which ensures that mating locking elements on the two container sections are fully engaged.

The apparatus of the invention automatically joins the container sections and folds the joined sections to provide a closed and locked container.

The apparatus of the invention can be used in any installation where it is necessary to join container sections and fold the sections to a closed condition.

Other objects and advantages will appear in the course of the following description.

DESCRIPTION OF THE DRAWINGS

The drawings illustrate the best mode presently contemplated of carrying out the invention.

In the drawings:

FIG. 5 is a top plan view of the mechanism shown in FIG. 4;

FIG. 6 is an enlarged top plan view of the mechanism for shifting the hinged container sections laterally on the conveyor;

FIG. 7 is a transverse section taken along lines 7—7 of FIG. 6;

FIG. 8 is an enlarged vertical section showing the spring loaded roller employed to lock the hinged container sections together;

FIG. 9 is a fragmentary enlarged side elevation of the end of an arm attached to the spring loaded roller;

FIG. 10 is a diagrammatic view showing the action of folding the hinged container sections;

FIG. 11 is a schematic view showing the folded container sections passing under the spring loaded roller; and FIG. 12 is a perspective view of the hinged container.

DESCRIPTION OF THE ILLUSTRATED EMBODIMENT

Figure 1:
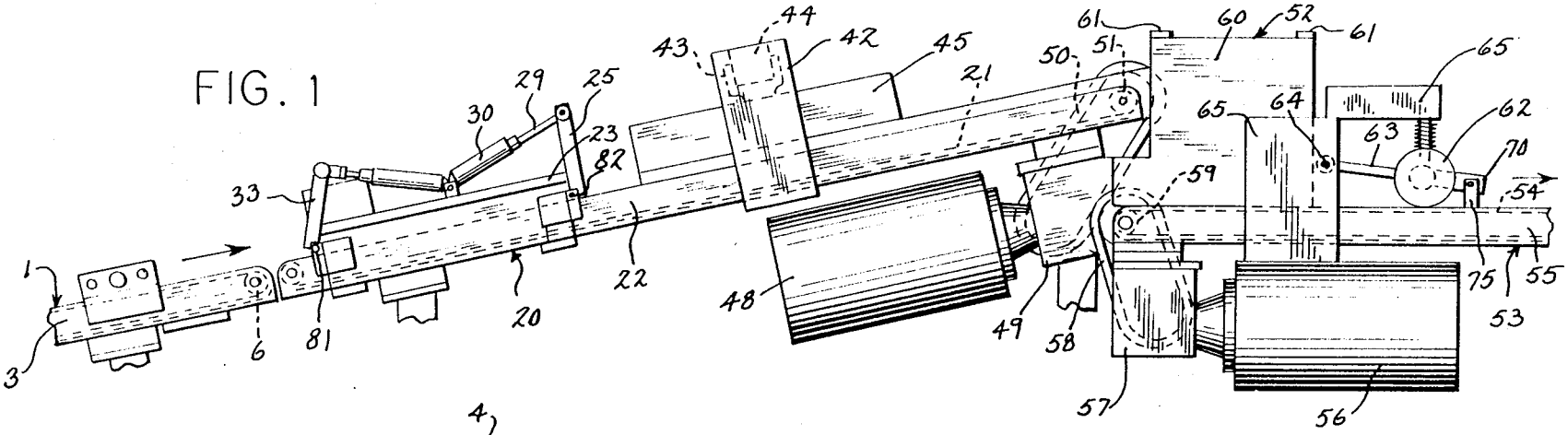
FIG. 1 is a side elevation of the appartus of the invention.
Figure 2:
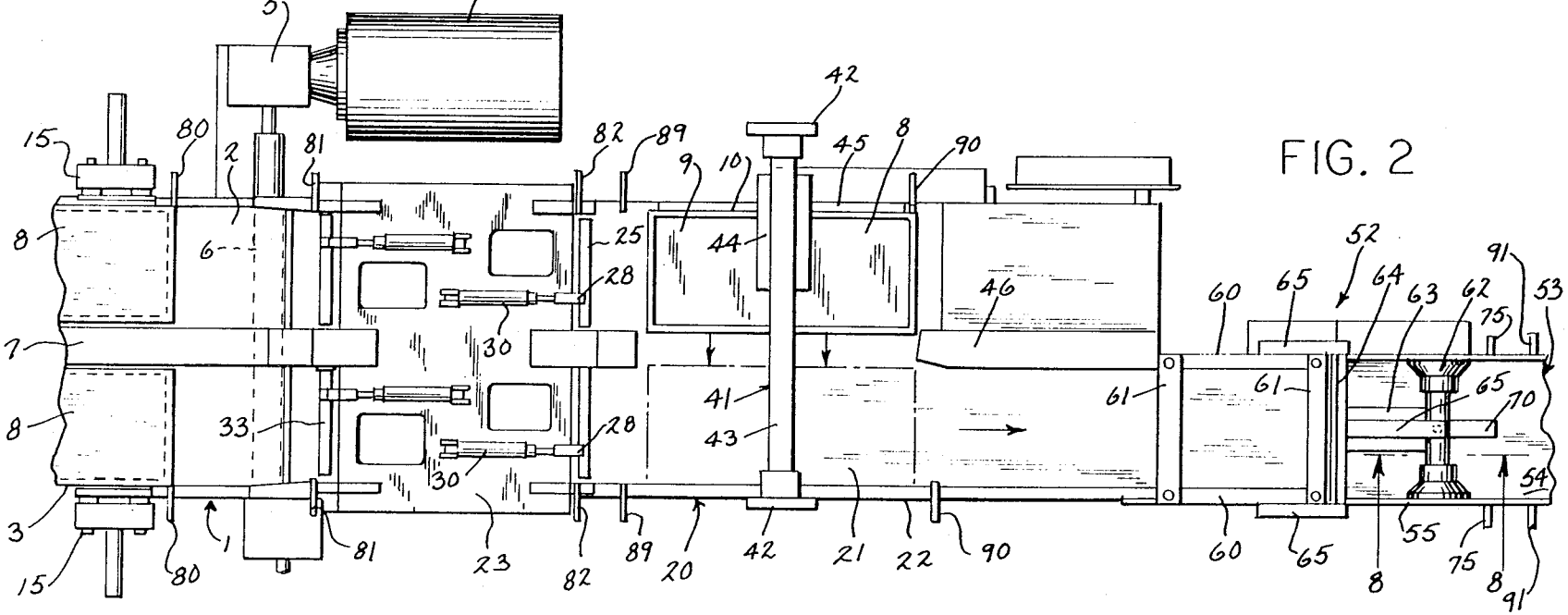
FIG. 2 is top plan view of the apparatus.

FIGS. 1 and 2 show a conveyor 1 comprising an endless conveyor belt 2 which is mounted for travel on a supporting frame 3. Belt 2 is driven in an endless path by a motor 4 which operates through a gear box 5 and the output of the gear box is connected to the shaft of a drive roller 6 of conveyor 1. With this construction, operation of the motor 4 will move the belt 2 in an endless path on frame 3.

Located centrally between the sides of conveyor 1 is a divider strip 7 which divides the conveyor into two parallel pathways. A plurality of open top, generally rectangular, container sections 8 and 9 are adapted to be conveyed along each pathway on conveyor 1. As best illustrated in FIG. 12, container sections 8 and 9 are adapted to be joined together to provide a hinged container 10. Container sections 8 and 9 have integrally formed hinge elements 11 and 12, respectively, which are adapted to be engaged through operation of the apparatus of the invention. In addition, sections 8 and 9 have mating locking elements 13 and 14, respectively, which are brought into engagement when the container sections are folded together to lock the sections in the closed condition.

Figure 3:
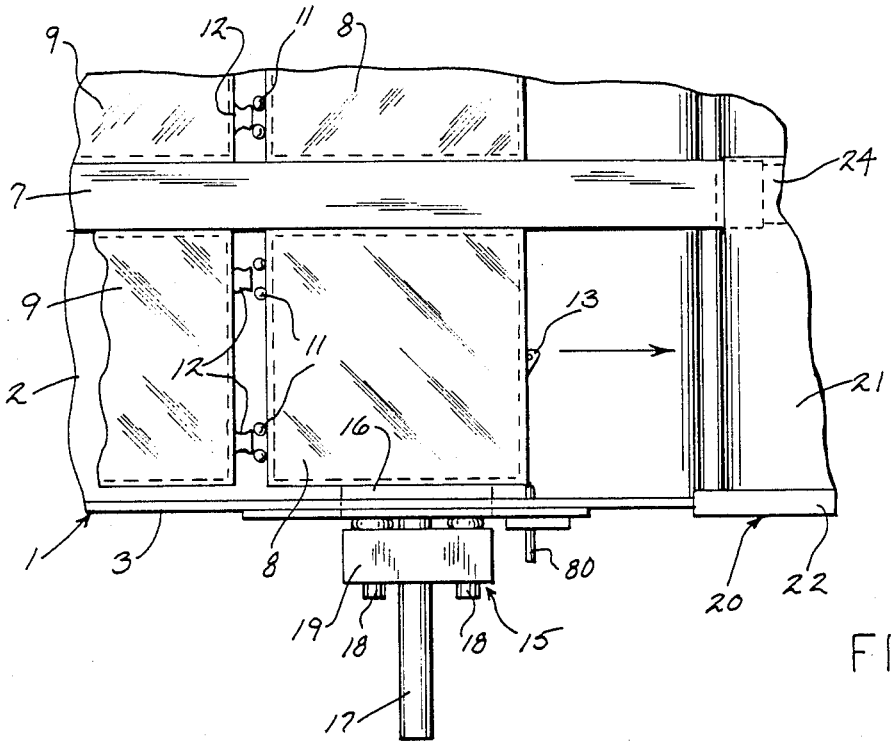
FIG. 3 is a fragmentary enlarged top plan view showing the squeezer mechanism for preventing movement of the container sections on the conveyor.

Conveyor belt 2 is adapted to operate continuously and in order to stop movement of the container sections 8 and 9, squeezer assemblies 15 are positioned along both sides of the conveyor 1 and act to squeeze and hold the sections 8 and 9 against the central divider strip 7. More particularly, each squeezer unit 15, as best shown in FIG. 3, includes a pusher plate 16 which is connected to the piston rod of a fluid cylinder unit 17. Pusher plate 16 also includes a pair of guide rods 18 located on either side of the cylinder unit 17 and guide rods 18 are mounted for sliding movement within support blocks 19 that are connected to the conveyor frame 3. By operating the cylinder units 17, the pusher plates 16 will be moved laterally inward to force the respective container sections 8 and 9 against the divider strip 7 to prevent movement of the container sections on the moving conveyor belt 2.

Located downstream of conveyor 1 is a second conveyor 20 that includes a conveyor belt 21 which is mounted for endless travel on frame 22.

A horizontal plate 23 is mounted in spaced relation above belt 21 and a divider strip 24 is suspended from plate 23 and is located in alignment with divider strip 7. As in the case of divider strip 7, divider strip 24 divides conveyor 20 into two pathways for movement of the container sections 8 and 9.

Figure 4:
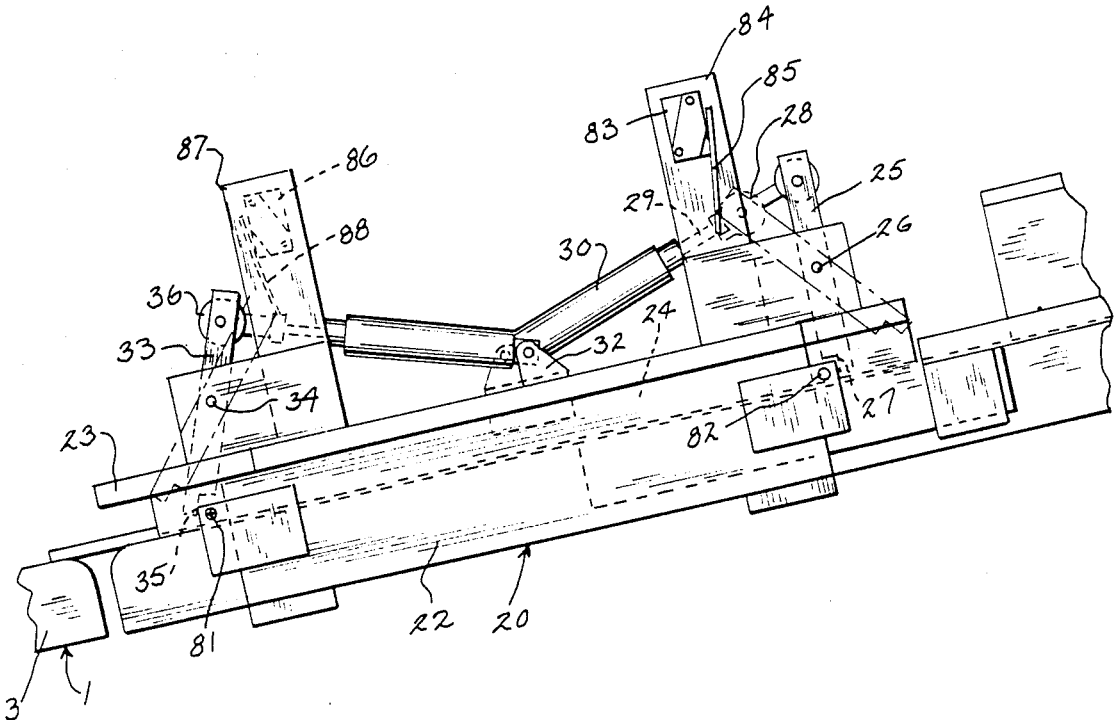
FIG. 4 is an enlarged side elevation with parts broken away showing the mechanism for joining the container sections.

Mounted for pivoting movement on the frame 22 is a stop bar 25 that extends transversely across belt 21. Stop bar 25 is mounted for pivotal movement on shaft 26 which extends between opposite sides of frame 22, and the lower end of stop bar 25 is provided with a notch 27, as shown in FIG. 4, which is adapted to engage the leading edge of the leading container section 8 as the container section moves along the conveyor belt 21.

Stop bar 25 is adapted to be moved between a nonobstructing position, where the lower end of the stop bar will not interfere with movement of the container sections 8 and 9 on belt 21, to a generally vertical obstructing position in which the lower end of the stop bar will be engaged by the container section 8 to stop movement of the container section.

To provide pivotal movement for the stop bar 25, trunnions 28 are connected to the upper edge of bar 25 and the outer end of a piston rod 29 that is slidable in fluid cylinder 30 is pivotally connected to each trunnion. The opposite end of each cylinder 30 is pivotally connected to lugs 32 that extend upwardly from plate 23. By introducing fluid into the lower ends of cylinders 31, rods 29 will be extended to pivot stop bar 25 from the angular nonobstructing position to the vertical obstructing position.

Located upstream from stop bar 25 is a pusher bar 33 which is pivotably connected through shaft 34 to conveyor frame 22. The lower end of bar 33 is provided with a notch 35, as illustrated in FIG. 4, which is adapted to engage the trailing end of the trailing container section 9 and push the section 9 downstream toward section 8 which has been stopped by stop bar 25. This action will cause the hinge elements 11 and 12 to be brought into snap fitting engagement to hinge the two sections 8 and 9 together.

To provide the pivoting action for pusher bar 33, a pair of trunnions 36 are connected to the upper edge of the bar and the outer end of a piston rod 37 that is slidable in cylinder 38 is pivotally connected to each trunnion 36. The opposite end of each cylinder 38 is pivotally connected to lugs 40 which extend upwardly from plate 23. With piston rods 37 retracted, the lower end of pusher bar 33 will be spaced above the conveyor belt 21 in a position where it will not interfere with movement of the container sections 8 and 9. By introducing fluid into the lower end of the cylinders 38, piston rods 37 will be extended to pivot bar 33 toward a vertical position. This will cause the notch 35 to engage the trailing end of container section 9 and push container section 9 toward the stopped section 8 to engage the hinge elements 11 and 12.

As illustrated in FIGS. 3 and 4, the container sections 8 and 9 pass through the joining zone in a double row, and a transfer mechanism is provided to move one row of the hinged containers into the other row to provide a single row in a downstream direction from the joining zone. As best illustrated in FIG. 6, a band cylinder unit 41 is mounted through brackets 42 to the sides of frame 22 of conveyor 20, and the cylinder unit 41 is spaced above the conveyor belt 21. Cylinder unit 41 includes a cylinder 43 and a carrier 44 is connected to the piston, not shown, of the cylinder and is adapted to move longitudinally of the cylinder. Carrier 44 is connected to a pusher plate 45 which is normally located along one side edge of convevor 20. By supplying fluid to the cylinder 43, carrier 44 will be moved laterally across conveyor 20, thereby correspondingly moving pusher plate 45 to transfer the hinged container 10 to the opposite side of the conveyor. The hinged containers will then be conveyed downstream in a single row.

A central guide strip 46 is located centrally of the conveyor belt 21 and is suspended from an arch 47 which extends across the conveyor and is connected to the sides of frame 22.

As illustrated in FIG. 1, belt 21 is driven in its endless path by a motor 48 which operates through gear box 49. The output shaft of gear box 49 is connected via a chain drive 50 to drive roller 51 of conveyor 20. Thus, operation of the motor 48 will rotate roller 51 to drive belt 21 in its endless path.

A folding unit 52, which acts to fold the hinged containers 10, is located downstream of the joining unit. Folding unit 52 consists of a conveyor 53 that includes a belt 54 mounted for endless travel on frame 55. Motor 56 operates through gear box 57 and the output shaft of gear box 57 is connected through chain drive 58 to drive roller 59 of conveyor 53.

As best illustrated in FIG. 10 the upstream end of conveyor 53 is located at a level beneath the downstream end of conveyor 20. The distance or height between the belts 21 and 54 is slightly less than the longitudinal dimension of the leading section 8.

A pair of side plates 60 extend upwardly from frame 55 on either side of conveyor 53, and the upper edges of side plates 60 are connected by cross bars 61.

FIGS. 10 and 11 best illustrate the manner in which the hinged container 10 is folded to a closed position. As the hinged container 10 approaches the end of conveyor 20, the leading section 8 will fall from the end of the conveyor 20, as illustrated in FIG. 10 and contact the belt 54 of the lower conveyor 53. Belt 54 is operating at a slower speed than the belt 21, or alternately is stationary, and thus the faster speed of the upper belt 21 will cause the hinged container to jackknife and move into a closed condition as shown in FIG. 11. Thus the transfer of the hinged container 10 from conveyor 20 to conveyor 53 will automatically fold the container into a closed condition.

The container sections 8 and 9, as previously noted, have locking elements 13 and 14 which are adapted to be brought into snapped interlocking relationship to hold the container in the closed position. In some cases the folding action, as shown in FIG. 10, may not be sufficient to provide complete engagement of locking elements 13 and 14. Therefore, a provision is made to pass the folded container 10 under a spring loaded roller 62 which will ensure that the locking elements 13 and 14 are in proper engagement.

As best illustrated in FIG. 8, roller 62 carries an arm 63 and the upstream end of arm 63 is pivotally connected to a shaft 64 which extends transversely across the conveyor and is connected to plates 65 of frame 55. As shown in FIG. 8, a coil spring 66 interconnects the shaft of roller 62 and a bar 67 which is mounted through a cross bar to plates 65. The upper end of sprinq 66 is located within a hole 68 in block 67, while the lower end of spring 66 is disposed within a hole 69 in the shaft of roller 62. The force of spring 66 will urge the roller downwardly against the folded container 10 as the container passes beneath the roller as illustrated in FIGS. 8 and 11.

Extending downstream from roller 66 is an arm 70 and the outer end of the arm is provided with an elongated vertical slot 71. Slot 71 is partially enclosed by a vertically adjustable plate 72, and to provide the adjustment, screws 73 extend through vertical slots 74 in the plate 72 and are threaded in arm 70. By adjustment of plate 72 the exposed vertical dimension of slot 71 can be varied.

A sensor 75, which can take the form of a photoelectric beam and receiver, is located along the sides of conveyor 53, and the beam is adapted to normally project through the exposed portion of slot 71. If the folded container 10 passing beneath roller 62 does not have the locking elements 13 and 14 properly engaged, roller 62 will be forced upwardly against the force of spring 66 thereby elevating the arm 70 and moving the slot 71 out of alignment with the beam of sensor 75. This action can either actuate a visual or audio alarm or can act to stop the conveying system so that the improperly folded container can be removed from the conveyor.

On the other hand, if due to some malfunction, only a single conveyor section 8 or 9 moves beneath the roller 62, arm 70 will be lowered beneath its normal position thereby interrupting the beam of sensor 75 to similarly cause an alarm or stop the conveying system.

Operation

Container sections 8 and 9 are introduced onto the conveyor 1 in two rows with each section 9 following a section 8. A sensor 80 is mounted on each side edge of conveyor 1 and sensors 81 and 82 are located downstream of the respective sensors 80. When sensor 80 senses the presence of a container section it operates cylinder 30 to move the stop bar 25 to the obstructing position. Sensor 82 will then sense the presence of the stopped section 8 and when sensor 81 senses the presence of the trailing section 9, the squeezer unit 15 is actuated to hold or retain the next suceeding container section 8 on the moving conveyor 1. When the trailing end of section 9 clears sensor 81, cylinders 38 are operated to move the bar 33 into contact with the trailing end of section 9 and move the hinged elements 11 and 12 into engagement.

A switch 83 is mounted on a bracket 84 extending upwardly from plate 23 and switch 83 carries a downwardly extending arm 85. Similarly, a second switch 86 is mounted on a bracket 87 from plate 23 and switch 86 carries an arm 88. Arms 85 and 88 will be actuated when the piston rods 29 and 37 are extended and the gates 25 and 33 are in the full down position. Actuation of the switches 83 and 86 when the gates 25 and 33 are in the full down position indicates proper engagement of the hinge elements 11 and 12 of the two container sections. If sensors 89 and 90 are clear at this time, meaning no container is at the location of sensors 89 and 90, the gates 25 and 33 will open and the squeeze units 15 will be released to enable a second pair of sections 8 and 9 to move into the joining unit. The downstream stop gate 25 will close when the sensor 89 indicates that the hinged container 10 has moved past that location.

If the right hand lane (as viewed in a downstream direction) is clear as determined by sensors 89 and 90, the pusher plate 45 will be operated to move the hinged container laterally from the left lane to form a single row in the right lane.

Sensor 91 is located downstream of the roller 62 and is adapted to sense the presence of a part or container beneath the roller. If sensor 91 senses the presence of a container and if the container sections are not properly snapped together, resulting in the roller 62 and arm 70 being at a raised location, or if only a single conveyor section somehow happens to enter the conveyor 53 causing the roller 62 and arm 70 to be at a lower position, the photoelectric sensor 75 will shut off power to the conveyor or alternately sound an alarm so that the container beneath the roller can be removed from the system.

With the system of the invention, the container sections 8 and 9 are automatically hinged together, folded to a closed condition and properly locked in the closed condition.

Various modes of carrying out the invention are contemplated as being within the scope of the following claims particularly pointing out and distinctly claiming the subject matter which is regarded as the invention.

We claim:

1. An apparatus for joining and folding container sections, comprising conveyor means to convey two container sections in end-to-end relation with one of said sections being a leading section and the other being a trailing section, said sections having adjacent ends, one end of said adjacent ends having a first hinge element and a second of said adjacent ends having a second hinge element to be pivotally engaged with the first hinge element to join said sections together, stop means to stop the leading section on said conveyor means, attaching means disposed to engage the trailing end of the trailing section to move the trailing section in a downstream direction to engage the hinge elements and provide a hinged connection therebetween, and folding means for folding one of said sections over the other to provide a closed container.

2. The apparatus of claim 1, and including guide means disposed in spaced relation above said conveyor means to provide a guide way to receive the container sections.

3. The apparatus of claim 1, wherein said attaching means comprises a pusher member movable between an inoperative position spaced above said conveyor means a sufficient distance so it will not interfere with movement of said sections on said conveyor and an operative position where said pusher member will engage the trailing end of said trailing section.

4. The apparatus of claim 3, wherein said pusher member is pivoted to said conveyor means and is swingable between the inoperative and operative positions.

5. The apparatus of claim 4, wherein said pusher member is pivoted about a transverse horizontal axis spaced above said conveyor means.

6. The apparatus of claim 1, wherein said conveyor means is an endless belt conveyor.

7. The apparatus of claim 1, wherein said folding means comprises a supporting surface disposed at a level beneath said conveyor means, the distance between said supporting surface and said conveyor means being slightly less than one-half the length of the hinged container, said supporting surface being constructed and arranged to be contacted by the leading end of a hinged container as said hinged container falls from the downstream end of said conveyor means, continued movement of said conveyor means acting to fold said sections to provide said closed container.

8. The apparatus of claim 7, wherein said supporting surface comprises second conveyor means constructed to move in the same direction as said first conveyor means and at a slower speed.

9. The apparatus of claim 1, wherein said stop means comprises a retractable stop member mounted for movement between an obstructing position where stop member will be engaged by the leading end of said leading section and a nonobstructing position where said stop member is spaced above said conveyor means a sufficient distance so it will not interfere with movement of said sections on said conveyor means.

10. The apparatus of claim 9, wherein said stop member is a swingable gate mounted for pivoting movement between the obstructing and non-obstructing positions.

11. The apparatus of claim 1, and including releasable holding means located upstream from said attaching means to engage and hold a leading container section on said moving conveyor means.

12. The apparatus of claim 11, wherein said holding means comprises a fixed abutment along one side of said conveyor and a power operated member disposed on the opposite side of said conveyor means and movable transversely with respect to said conveyor means whereby movement of said power operated means will force said leading section against said abutment to hold said leading section against movement.

13. An apparatus for joining and folding container sections, comprising first conveyor means to convey two container sections in end-to-end relation with one of said sections being a leading section and the other being a trailing section, said sections having adjacent ends, one end of said adjacent ends having a first hinge element and a second of said adjacent ends having a second hinge element to be pivotally engaged with the first hinged element to join said container sections together, joining means for moving said container sections relative to each other while supported on said conveyor means to engage said hinge elements and join said sections together to provide a hinged container, and folding means for folding one of said sections over the other to provide a folded container, said folding means comprising a supporting surface disposed at the downstream end of said first conveyor means and disposed at a level beneath said first conveyor means, the distance between said supporting surface and said first conveyor means being slightly less than one-half the length of the hinged unfolded container, said supporting surface being constructed and arranged to be contacted by the leading end of the hinged container as the hinged container falls from the downstream end of said conveyor means, continued movement of said conveyor means acting to fold said sections to provide said folded container.

14. The apparatus of claim 1 wherein said supporting surface comprises second conveyor means constructed to move in the same direction as said first conveyor means and at a lower speed.

15. The apparatus of claim 1, and including pressure means for urging the folded container into a fully closed condition.

16. The apparatus of claim 15, wherein said pressure means comprises a roller disposed above said second conveyor means, said folded container disposed to move on said second conveyor means beneath said roller, and biasing means for urging the roller downwardly against said folded container.

17. The apparatus of claim 1, and including sensing means for sensing the vertical position of said roller above said second conveyor means, said sensing means being operably connected to said second conveying means to stop operation of said apparatus if the roller when engaged with a folded container departs from a predetermined vertical position.

18. A method of joining and folding container sections, comprising the steps of forming a pair of container sections with each container section having hinge elements constructed and arranged to be engaged with hinge elements of the other section to provide a hinge connection between said sections, disposing said pair of container sections on a moving first conveyor in end-to-end relation with the hinge elements on a first of said container sections facing the hinge elements on a second of said container sections, said first section leading said second section in the direction of movement of said conveyor, moving at least one of said container sections in a direction toward the other container section while said sections are supported on the conveyor to join the hinge elements and provide a hinged container, discharging the hinged container from an end of said first conveyor, engaging the leading end of said first section with a second conveyor disposed at a lower level than said first conveyor, and operating said second conveyor in the same direction as said first conveyor and at a slower speed to cause said second section to fold over said first section and provide a closed container.

19. The method of claim 1, and including the step of passing the closed container under a downwardly biased pressing member to ensure full closure of said container sections.

20. The method of claim 1, wherein the step of joining comprises stopping said first section on said first conveyor, engaging a pushing member with the trailing end of said second section to urge the hinge elements of said second section into engagement with the hinge elements of said first section.

21. The method of claim 19, including the step of exerting a downward pressure on the closed container as it moves on said second conveyor to ensure full closure of said container sections.

22. A method of jooining and folding container sections, comprising the steps of forming a pair of container sections with each container section having hinge elements constructed and arranged to be engaged with hinge elements of the other section to provide a hinge connection between said sections, disposing said pair of container sections on a moving first conveyor in end-to-end relation with the hinge elements on a first of said container sections facing the hinge elements on a second of said container sections, said first section leading said second section in the direction of movement of said conveyor, moving at least one of said container sections in a direction toward the other container section while said sections are supported on the conveyor to join the hinge elements and provide a hinged container, discharging the hinged container from an end of said first conveyor, engaging the leading end of said first section with a surface disposed at a lower level than said first conveyor, and continuing the operation of said first conveyor after said leading end contacts said surface to cause said second section to fold over said first section and provide a closed container.

* * * * *